US010443352B2

(12) United States Patent
Cleven

(10) Patent No.: US 10,443,352 B2
(45) Date of Patent: Oct. 15, 2019

(54) CHECK VALVE

(71) Applicant: COMITT WELL SOLUTIONS US HOLDING INC., Katy, TX (US)

(72) Inventor: Peter Kris Cleven, Grand-Barachois (CA)

(73) Assignee: COMITT WELL SOLUTIONS US HOLDING INC., Katy, TX (US)

( * ) Notice: Subject to any disclaimer, the term of this patent is extended or adjusted under 35 U.S.C. 154(b) by 199 days.

(21) Appl. No.: 15/888,241

(22) Filed: Feb. 5, 2018

(65) Prior Publication Data

US 2018/0163511 A1 Jun. 14, 2018

Related U.S. Application Data

(63) Continuation of application No. PCT/US2016/050330, filed on Sep. 5, 2016.

(30) Foreign Application Priority Data

Sep. 5, 2015 (NO) ..... 20151137

(51) Int. Cl.

| | |
|---|---|
| ***E21B 34/14*** | (2006.01) |
| ***E21B 34/08*** | (2006.01) |
| *E21B 34/10* | (2006.01) |
| *E21B 43/26* | (2006.01) |
| *E21B 34/00* | (2006.01) |

(52) U.S. Cl.
CPC ..... *E21B 34/14* (2013.01); *E21B 34/08* (2013.01); *E21B 34/10* (2013.01); *E21B 43/26* (2013.01); *E21B 2034/005* (2013.01)

(58) Field of Classification Search
CPC ..... E21B 2034/005; E21B 34/14; E21B 34/08
See application file for complete search history.

(56) References Cited

U.S. PATENT DOCUMENTS

| | | | | |
|---|---|---|---|---|
| 4,641,707 | A | 2/1987 | Akkerman | |
| 4,706,933 | A | 11/1987 | Sukup | |
| 8,651,188 | B2 | 2/2014 | Scarsdale | |
| 2013/0081824 | A1 | 4/2013 | Hill, Jr. et al. | |
| 2017/0356273 | A1 * | 12/2017 | Bayh, III | E21B 34/10 |

* cited by examiner

*Primary Examiner* — Kristyn A Hall
(74) *Attorney, Agent, or Firm* — Pierson IP, PLLC

(57) ABSTRACT

A check valve for an injection string, comprises a cylindrical house with a central bore. A piston has a piston area exposed to the central bore, a protective sleeve at one end and a contact point affixed to the piston. A return spring is arranged between the house and the contact point so as to oppose a pressure force exerted on the piston area. A flapper valve—comprises a blade rotatable about a hinge between a closed position where the blade blocks a reverse flow through the central bore and an open position where the blade is received in a recess in a wall of the central bore. The piston is axially movable within the house between a first position where the protective sleeve is displaced from the recess and a second position where the protective sleeve covers the recess.

7 Claims, 1 Drawing Sheet

CHECK VALVE

BACKGROUND

Field of the Invention

The present invention relates to tools for use in a wellbore. More particularly, the invention concerns a check valve for an injection string.

Prior and Related Art

As used herein, a wellbore is a wholly or partially cased borehole through a geological formation. In the following description and claims, "uphole" refers to the direction toward the surface, regardless of the inclination of the wellbore with respect to the vertical. Similarly, "downhole" refers to the opposite direction. That is, "downhole" does not mean "within the wellbore" in the following description and claims.

During stimulation and hydraulic fracturing, an injection string is inserted into a wellbore while a fluid is circulated downhole through the string and returned uphole through an annular space between the string and the wellbore. The string is provided with an injection valve placed between uphole and downhole isolation packers. When the packer and valve assembly is positioned at the zone to be stimulated, the pump rate is increase. This increases a bore pressure within the string and causes the isolation packers to set and the injection valve, e.g. a sliding sleeve valve, to open. The injection may require a bore pressure in the order of 70 bar (1000 psi) over the normal pressure at the rock face, i.e. the pressure before injection. Integrated assemblies for performing the above operations are described in previous patent applications assigned to the assignee of the present disclosure.

A further development is described in NO20150652A1 assigned to the present assignee. The subject matter of this application includes a mechanically operated (MO) valve assembly uphole from the pressure activated packer and valve assembly to flush sand and debris away from the annular space around the string after injection, such that the pressure activated valve and packer assembly may be moved to another location or retrieved. The MO valve assembly may comprise an MO packer uphole from an MO valve. Both MO devices are operated by manipulating the string from the surface, in particular by sequences of down-weights, right-hand-turns and pull-ups. Thus, the mechanically operated devices operate independent of the pressure within the string. The MO-devices require an anchor to fix a downhole part of the string with respect to the wellbore.

During injection and/or flushing, there is a need to avoid reverse flow, e.g. kicks as known in the art. Hence, it is beneficial to include a check valve in the injection string. However, a check valve is subject to corrosion and/or abrasion from the injection fluids used in stimulation and fracturing operations.

The objective of the present invention is to provide an improved check valve that solves or reduces at least one of the problems above while retaining the benefits of prior art.

SUMMARY OF THE INVENTION

The above objectives are achieved by a check valve according to claim 1.

More particularly, the invention provides a check valve for an injection string, comprising a cylindrical a cylindrical house with a central bore. The protective device further comprises a piston with a piston area exposed to the central bore, a protective sleeve at one end and a contact point affixed to the piston. A return spring is arranged between the house and the contact point so as to oppose a pressure force exerted on the piston area. A flapper valve has a blade rotatable about a hinge between a closed position where the blade blocks a reverse flow through the central bore and an open position where the blade is received in a recess in a wall of the central bore. The piston is axially movable within the house between a first position where the protective sleeve is displaced from the recess and a second position where the protective sleeve covers the recess.

Assume an initial circulation flow down the string. If the flapper valve is closed, it will open at some flow rate because it is configured to block a reverse flow. Whether the flapper valve was initially open or closed, the flapper blade is received in the recess at this point. As the bore pressure increases, the pressure force exerted on the piston area increases. At an intermediate pressure, the pressure force overcomes the spring force from the return spring, such that the piston starts to move axially. As the contact point moves relative to the house, the spring force increases according to Hooke's law. When the protective sleeve finally covers the recess, and hence the flapper blade, the spring force has a preset value that is overcome by the bore pressure acting on the piston area.

The skilled person will realize that a reverse flow is much less likely to occur during injection, i.e. at an increased pump rate and a bore pressure e.g. 1000 psi over the ambient pressure, than at circulation with substantially less pump rates and bore pressures.

Thus, the pressure at which the protective sleeve starts to move, and potentially block the flapper blade, should be set at an intermediate value, e.g. 350 psi. Accordingly, the return spring is preferably pre-tensioned in the first position to provide a return force equal to and opposite a pressure force caused by an intermediate bore pressure exerted on the piston area. The term "pre-tensioned" includes embodiments wherein the return spring is compressed, as well as embodiments wherein the return spring is extended.

In a further preferred embodiment, the return spring is tensioned in the second position to provide a return force less than the pressure force caused by the injection pressure exerted on the piston area. Thereby, the flapper blade is covered by the protective sleeve before injection, e.g. before proppants are added to the injection fluid during hydraulic fracturing. The term "tensioned" covers compressed and extended return springs as above.

The house may comprise a length adjustment section. The length of the house determines the axial difference between the first and second positions, and hence the difference between the final and intermediate pressures.

In preferred embodiments, the house comprises a return spring cover, i.e. a cover over the return spring. This facilitates manufacture, as the return spring cover may be mounted after the return spring.

In preferred embodiments, the house comprises a flapper house comprising the hinge and the recess. This allows separate manufacture of the flapper valve, including manufacture by a third party. That is, any flapper valve with a recess to receive the flapper blade may be included in the present invention.

The flapper valve preferably comprises a flapper spring setting an opening pressure. It follows that the spring force from the flapper spring is directed opposite the pressure force caused by the bore pressure exerted on the flapper blade. Further features and benefits will become apparent from the dependent claims and the detailed description.

BRIEF DESCRIPTION OF THE DRAWINGS

The invention will be explained by means of exemplary embodiments with reference to the drawings, in which.

DETAILED DESCRIPTION

The drawings are schematic to illustrate the principles of the invention, and are not necessarily to scale. Numerous details known to one of ordinary skill in the art are omitted from the drawings and the following description.

Figure 1:
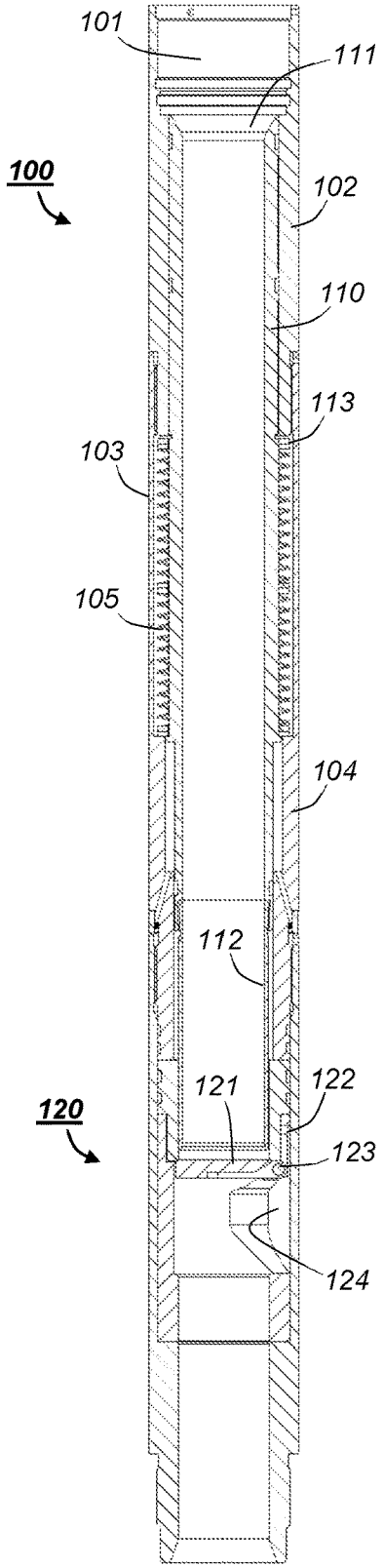
FIG. 1 is a longitudinal section of the check valve with the flapper closed.

FIG. 1 illustrates a protective device 100 with the flapper valve 120 closed. This is the state if an undesired flow in the uphole direction occurs and perhaps during run-in.

The protective device 100 comprises a piston 110 axially movable in a house with a length adjustment section 102, a return spring cover 103 for a return spring 105 and a flapper house 104.

The piston 110 comprises a piston area 111 exposed to the bore pressure, a protective sleeve 112 and a protrusion 113 contacting one end of the return spring 105. In the illustrated embodiment, the return spring is contracted. In other embodiments, the return spring 105 may be extended to achieve the same effect, i.e. to provide a spring force opposing the pressure force exerted on the piston area 111.

The piston area 111 is much greater than the radially extending area of the protective sleeve 112 exposed to the bore pressure. Thus, the piston 110 moves downhole when the bore pressure increases. For convenience, the piston area 111 is considered a net piston area in the following description and claims. That is, the actual pressure force acting on the piston area 111 minus a pressure force acting on the end of the protective sleeve 112 is regarded as a pressure force exerted on the piston area 111. The relevant issue is that a pressure force caused by the bore pressure opposes a return spring force from the return spring 105.

During run-in, a fluid flows downhole and causes the flapper 120 to open. More particularly, the pressure from this downhole flow exerted on a blade 121 exceeds the spring force from a flapper spring 122 such that the blade 121 swings about a hinge 123 into a recess 124. This action is not shown in the drawings.

When the bore pressure increases before injection, for example at 24 bar (350 psi), the sleeve 110 begins to activate. That is, the net pressure force exerted on the piston area 111 starts to overcome an opposing spring force from the return spring 105 at some pressure, e.g. 24 bar (350 psi).

As the bore pressure increases, the net pressure force on the piston 110 increases. The pressure induced force is opposed by a spring force from the spring 105 acting on the piston 110 through the contact point 113 affixed or attached to the piston 110.

Figure 2:
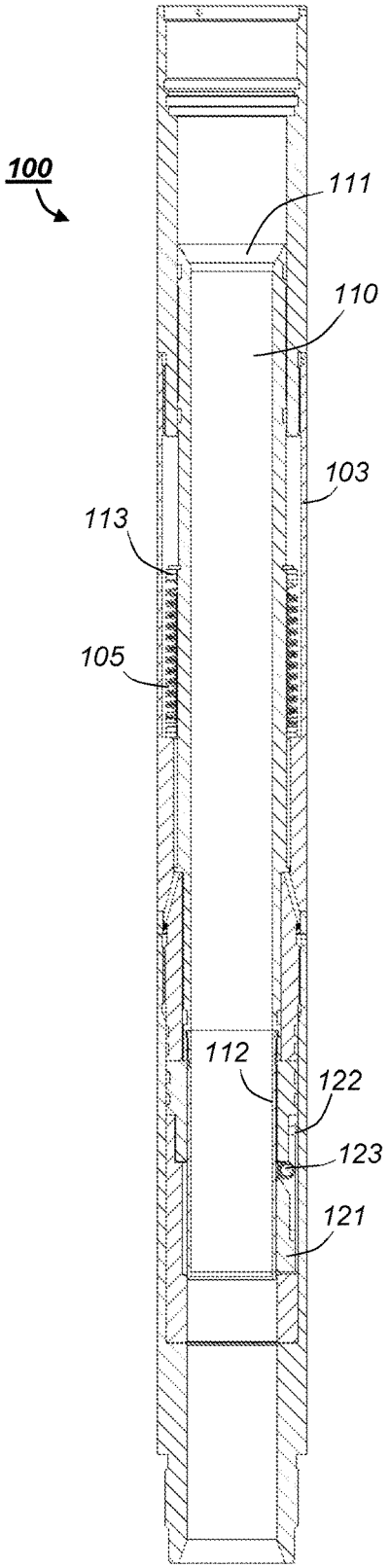
FIG. 2 shows the check valve in FIG. 1 during injection.

FIG. 2 shows the device in FIG. 1 in a second state wherein the protective sleeve 112 covers the flapper valve 120. As the return spring force is proportional to the contraction of spring 105 in this example, the bore pressure acting on the piston area 111 has increased compared to the state shown in FIG. 1. In other words, the length and stiffness of spring 105 and the piston area 111 may be configured such that the protective sleeve 112 covers the flapper valve 120 at some predetermined bore pressure, for example 55 bar (800 psi), which is below the injection pressure, in the present example 70 bar (1000 psi).

The invention has been described by way of examples. However, the scope of the invention is determined by the accompanying claims.

The invention claimed is:

1. A check valve for an injection string, comprising:

a cylindrical housing with a central bore;

a piston with a piston area exposed to the central bore, the piston area being positioned at a proximal end of the piston;

a protective sleeve positioned at a distal end of the piston and having a contact point affixed to the piston, wherein the piston area is greater in size than a radially extended area associated with the protective sleeve;

a return spring arranged between the housing and the contact point so as to oppose a pressure force exerted on the piston area;

a flapper valve with a blade rotatable about a hinge between a closed position where the blade blocks a reverse flow through the central bore and an open position where the blade is received in a recess in a wall of the central bore, wherein the flapper valve moves between the closed position and the open position based on a bore pressure increasing above a first bore threshold;

wherein the piston is axially movable within the housing between a first position where the protective sleeve does not cover the recess and a second position where the protective sleeve covers the recess, wherein the piston is configured to move from the first position to the second position after the flapper valve rotates from the closed position to the open position, wherein the protective sleeve is configured to move from the first position to the second position based on the bore pressure increasing above a second bore threshold, wherein the second bore threshold is greater than the first bore threshold.

2. The check valve according to claim 1, wherein the return spring is pre- tensioned in the first position to provide a return force equal to and opposite a pressure force caused by an intermediate bore pressure exerted on the piston area.

3. The check valve according to claim 1, wherein the return spring is tensioned in the second position to provide a return force less than a pressure force caused by an injection pressure exerted on the piston area.

4. The check valve according to claim 1, wherein the housing comprises a length adjustment section.

5. The check valve according to claim 1, wherein the housing comprises a return spring cover.

6. The check valve according to claim 1, wherein the housing comprises a flapper housing comprising the hinge and the recess.

7. The check valve according to claim 1, wherein the flapper valve further comprises a flapper spring setting an opening pressure.

* * * * *